United States Patent [19]

Bell et al.

[11] 4,011,536

[45] Mar. 8, 1977

[54] LIQUID SENSOR

[75] Inventors: Lon E. Bell, Altadena; Robert W. Diller, Pasadena, both of Calif.

[73] Assignee: Technar Incorporated, Arcadia, Calif.

[22] Filed: Nov. 25, 1974

[21] Appl. No.: 526,470

[52] U.S. Cl. ..... 337/141; 337/382; 337/394

[51] Int. Cl.[2] ..... H01H 61/02

[58] Field of Search ..... 73/290, 295, 304; 340/59; 337/140, 141, 395, 393, 131, 135, 136, 391, 396, 382, 394

[56] References Cited

UNITED STATES PATENTS

| | | | |
|---|---|---|---|
| 2,761,924 | 9/1956 | Keenan | 73/295 X |
| 2,782,285 | 2/1957 | Cantlin | 73/295 |
| 3,205,709 | 9/1965 | Gearing et al. | 73/295 |
| 3,760,352 | 9/1973 | Marcoux | 73/295 X |

*Primary Examiner*—J D Miller
*Assistant Examiner*—Fred E. Bell
*Attorney, Agent, or Firm*—Christie, Parker & Hale

[57] ABSTRACT

A sensor which utilizes the difference in thermal characteristic between two fluids to detect the presence of one fluid or the other. A continuously heated thermal expansion element activates a switch. When the element is brought in thermally conductive contact with a liquid, the heated element drops in temperature, shortening the length of the expansion element and activating the switch.

6 Claims, 5 Drawing Figures

LIQUID SENSOR

FIELD OF THE INVENTION

This invention relates to liquid sensors, and more particularly to a sensor utilizing a thermally actuated switch element.

BACKGROUND OF THE INVENTION

A number of devices have been proposed for sensing liquids to determine a liquid level, for example, or sense the presence or absence of liquid in a flow line. However, there is a need for a low-cost sensor, particularly in the automotive field, for sensing liquids and providing a remote indication or control. In addition to being low in cost, it is desirable that the sensor be rugged and foolproof. It must have long term stability and reliability, must operate over a wide temperature range, and be capable of operating with a variety of fluids, including flammable, corrosive, and electrically conductive liquids.

SUMMARY OF THE INVENTION

The present invention is directed to an electromechanical liquid sensor in which a temperature sensitive expansion element is heated to maintain its temperature above ambient. The switch means is actuated in response to changes in length of the expansion element, the switch responding to changes in temperature which occur when liquid is brought in thermally conductive relation with the expansion element. In one form of the invention the expansion element is in direct contact with the liquid. In another form of the invention, the expansion element and associated switch are isolated from the liquid by a thermally conductive housing.

DESCRIPTION OF THE DRAWINGS

For a more complete understanding of the invention reference should be made to the accompanying drawings, wherein.

DETAILED DESCRIPTION

Figure 1:
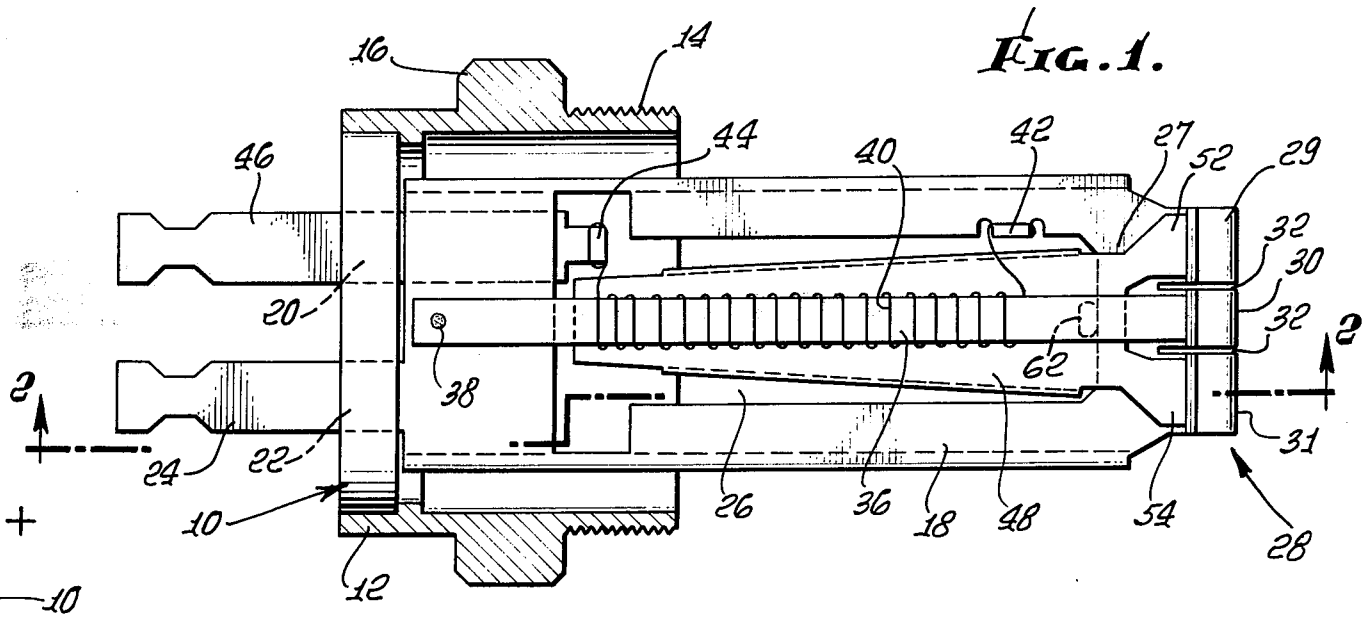
FIG. 1 is a front elevational view of a first embodiment of the invention.
Figure 2:
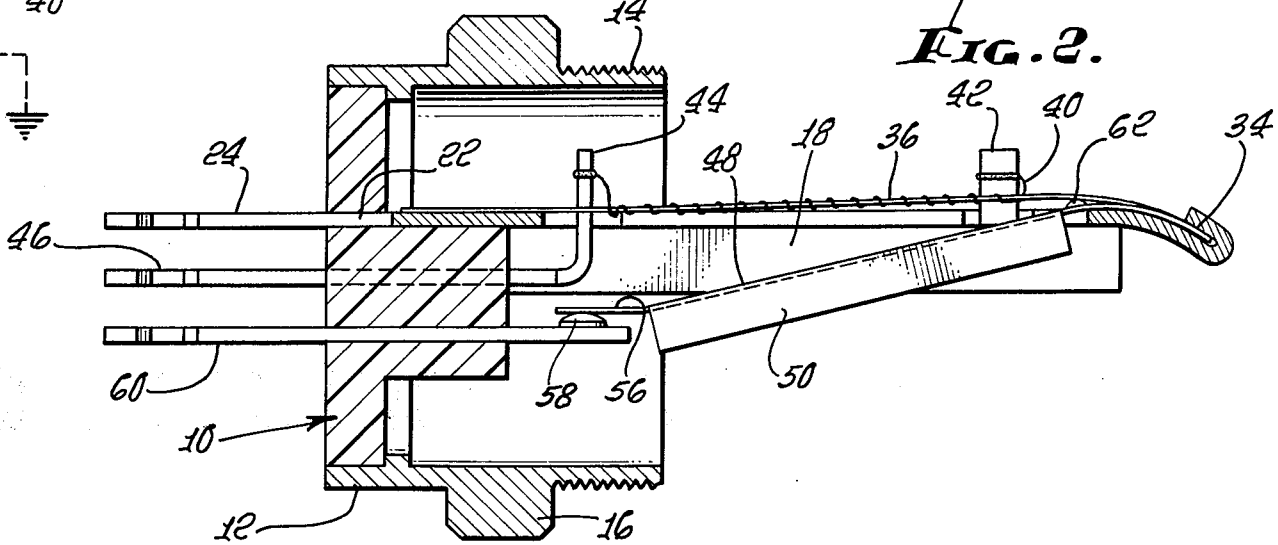
FIG. 2 is a cross-sectional view taken on the line 2—2 of FIG. 1.
Figure 3:
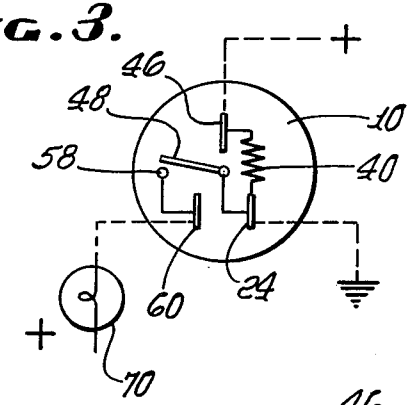
FIG. 3 is a schematic wiring diagram of the sensor.

Referring to the embodiment shown in FIGS. 1–3, there is shown a liquid sensor which can be used with fluids that are relatively inert, that is, fluids which are nonconductive and non-inflammable, so that the electrically active parts of the sensor may be exposed to the fluid. Referring to the drawings in detail, the numeral 10 indicates generally a base which is made of a nonconductive material, such as a phenolic. The base in turn may be seated in a suitable mounting plug 12, for example, having an externally threaded portion 14 and a hexagonal nut portion 16 by which it can be screwed into a threaded hole in the wall of a tank, an engine block, or the like. The specific mounting arrangement forms no part of the present invention and can be varied according to the environment in which the sensor is to be used.

A metal frame member 18, which is channel-shaped to give it stiffness, is mounted on the base 10. To this end the lower portion of the frame 18 has a pair of tabs 20 and 22 which are embedded in the base 10, the tab 22 projecting through the base to form an electrical terminal 24. The frame 18 has an elongated central opening 26 forming a cross member 27 at the outer end. The outer end of the frame member 18 forms a mounting portion indicated generally at 28 which is divided into three sections 29, 30, and 31 by a pair of slits 32. As best seen in FIG. 2, the mounting portion 28 of the frame member 18 is curved slightly with the outer edge being folded or doubled back on itself, as indicated at 34.

An expansion element 36 in the form of a flat actuator band is secured at both ends to the frame 18 and bridges the length of the opening 26. To this end one end of the expansion element 36 is spot-welded or otherwise secured to the frame 18 adjacent the base 10, as indicated at 38. The other end of the expansion element 36 is secured to the center section 30 of the mounting portion 28 by being clamped and spot-welded under the folded portion 34. A heater wire 40, or other suitable electrical heating means, such as printed circuit type resistance element, is wrapped around or secured to the surface of the expansion element 36 to apply heat to the expansion element. One end of the electrical heating element is connected to a binding post 42 on the frame 18. The other end of the heating element is connected to a binding post 44 on the end of an electrical terminal 46 extending through the base 10.

The sensor includes an electrical switch having a moving contact arm 48 preferably made of a flat spring material such as beryllium-copper, or the like. However, the cantilever arm and frame may be made of one piece. The moving contact arm 48 is stiffened over a substantial portion of its length by bending the edges to form a channel, as indicated at 50. The moving contact arm 48 is supported in cantilever fashion from the outer section 29 and 31 of the mounting portion of the frame member. To this end, the moving contact member 48 is bifurcated to form two portions 52 and 54 which extend on either side of the centrally positioned expansion member 36 and are clamped by the folded portion 34 of the frame member 18. The moving contact arm 48 passes between the cross member 27 of the frame 18 and the expansion element 36. The arm 48 extends through the opening 26. The freely moving end of the moving contact arm 48, indicated at 56, moves into and out of engagement with a fixed contact 58 on the end of an electrical terminal 60 extending through the base 10.

The moving contact arm 48 is formed with a projection or dimple 62 within the area of the opening 26 adjacent the cross member 27 where the moving contact engages the frame 18. The dimple 62 projects towards and is in contact with the overlying expansion element 36. Force applied against the dimple 62 by the expansion element tends to bend the spring material of the moving contact 48 about the adjacent edge of the opening 26, thus moving the free end 56 of the moving contact arm 48 relative to the fixed contact 58. Greater force is applied to the dimple 62 by the expansion member 36 when it contracts or becomes shorter. As the expansion member 36 heats up and expands, the force exerted against the dimple 62 is reduced, and the spring action of the moving contact arm 48 causes it to straighten and move away from the fixed contact 58.

In operation, under ambient temperature conditions, the tension in the expansion member 36 is adjusted by bending the associated mounting section 30 of the frame 18 to which the expansion member is attached. The tension is adjusted so as to deflect the moving contact 48 into contact with the fixed contact 58. When placed in operation, the heater 40 is connected to a source of electric current, such as a battery. This heats up the expansion member 36, causing it to expand in length and thereby reduce the tension in the expansion element. This reduces the force exerted against the dimple 62 and causes the end 56 of the moving contact arm 48 to move away from the fixed contact 58. The current through the heater is adjusted so that when the sensor unit is surrounded by a gas or vapor, the rate of heat loss from the expansion element is relatively low and the temperature rises substantially above ambient. However, when the unit is immersed in the liquid, the rate of heat loss from the expansion element increases and its temperature drops. The drop in temperature causes the expansion element to contract, forcing the moving contact 48 toward the fixed contact 58. It will be appreciated that the materials for the frame 18 and the expansion element 36 are selected such that ambient changes in temperature which affect both the temperature of the frame and the temperature of the expansion element do not change the tension in the expansion element, since both the frame and the expansion element expand and contract together. Only when the expansion element is heated with respect to the frame by the heating element 40 is there a differential expansion which produces movement of the contact arm 48.

While not specifically shown, it will be appreciated that a fixed contact could be provided on the opposite side of the end 56 to provide normally closed contacts and normally open contacts in the sensor unit. As shown in FIG. 3, the moving contact arm 48 can be used to provide a current path between the terminals through any suitable load, such as an indicator light 70.

Figure 4:
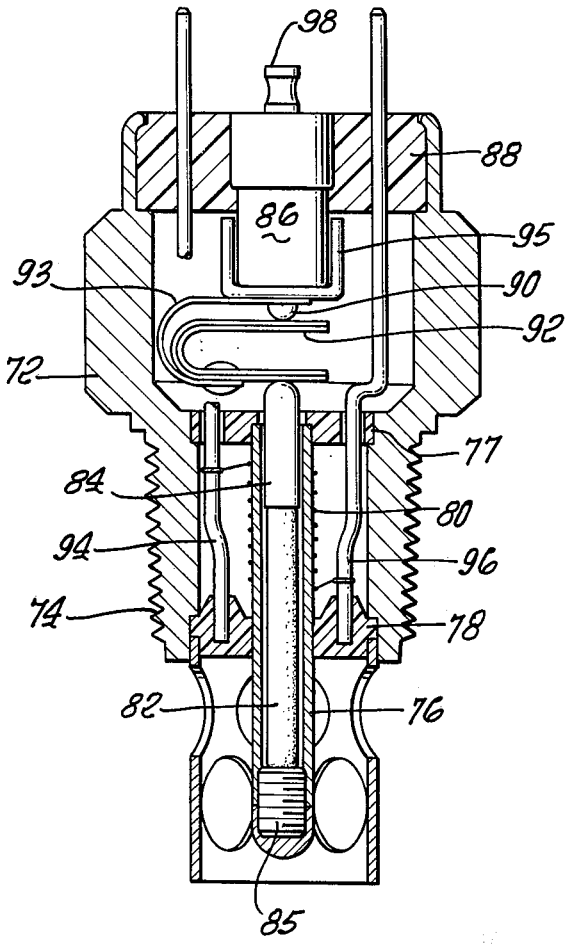
FIG. 4 is a cross-sectional view of a second embodiment of the present invention.

An alternative embodiment is shown in FIG. 4 where the liquid sensor may be exposed to a liquid which has properties that necessitate its isolation from the electrical and other active portions of the sensor. The sensor unit of FIG. 4 includes an outer cylindrical housing 72, and may, for example, have an externally threaded portion 74 for mounting the sensor unit. A sensor probe in the form of a thin hollow metallic tube 76 projects from the sensor unit through the externally threaded portion 74. The tube 76 is held in position by spaced insulating walls 77 and 78 made of a phenolic or other suitable material. Wrapped around the tube 76 is an electrical heating element 80. An expansion material is positioned inside the tube 76, as indicated at 82. In order to get substantial expansion with relatively small temperature changes, materials having a high coefficient of expansion are used. For example, plastic materials such as silicon rubber or fluoroplastics, or metals such as zinc or special high expansion alloys are used. In the case of silicon rubber which is a very soft material, the inner end of the tube is provided with a piston 84. The outer end of the tube has a calibrating screw 85 for adjusting the position of the expansion element 82.

Movement of the piston 84 within the tube 76 with expansion and contraction of the expansion material 82 actuates a microswitch 86. The switch 86 is secured to an end wall 88 made of nonconductive material which is inserted in the end of the housing 72. The switch has an actuating plunger 90 which is linked to the piston 84 by a U-shaped linkage member 92. The linkage member 92 is sufficiently stiff to transfer the motion of the piston 84 to the plunger 90 to actuate the switch 86 as the expansion material 82 expands and contracts. A spring member 93 supports the linkage member 92 to hold it in place. A channel-shaped bracket 95 fits over the switch 86 and anchors the spring member 93.

In operation, the heater 80 is connected to suitable terminals 94 and 96 which extend through the end wall 88. These terminals in turn are connected across an electric current source, such as a battery. The heat applied by the heater 80 elevates the temperature of the expansion material 82 causing the piston 84 to move up and actuate the switch 86. When the tube 76 comes in contact with a liquid, heat is conducted away from the expansion material 82 causing it to contract, releasing the switch 86. The contacts of the switch are connected to output terminals 98 for connection to an external load.

To compensate for variations in ambient temperature the U-shaped linkage member 92 may be made from a strip of bimetallic material. The material bends with changes in temperature so that the ends of the U-shaped element move further apart when the ambient temperature goes down, thereby compensating for the contraction of the expansion material 82.

Figure 5:
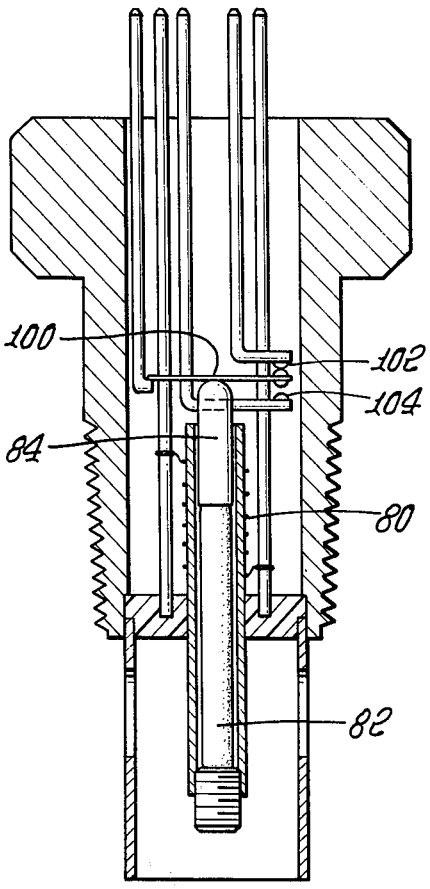
FIG. 5 is a sectional view of a modified form of the embodiment of FIG. 4.

In the arrangement of FIG. 5, the snap-action switch is replaced by slow make and brake contacts. In this arrangement, the piston 84 pushes against a cantilever supported moving contact 100. The moving contact arm 100 moves between a pair of fixed contacts 102 and 104 as the piston 84 moves up and down. The cantilever arm 100 of the moving contact is constructed of a bimetallic material. Thus changes in ambient temperature produce a bending of the moving contact arm 100 in a direction to compensate for changes in position of the piston 84.

From the above description, it will be seen that a sensor is provided which responds to the differences in thermal conductivity of the actuating fluid. Temperature compensation permits the device to respond to temperature changes due to differences in the heat conductive characteristics of the gas and liquid phases that are substantially less than the ambient temperature changes over which the device can operate. Sensitivity of the device is such that a very small amount of power is required since the expansion element need be heated only through a small temperature rise relative to the ambient temperature of the system.

The sensor device not only reacts to a change from a liquid to a gas, but to a change between any two fluids of different thermal characteristics. It also is actuated by a difference in cooling by the same fluid moving at different velocities. Thus the device may be used to sense the presence of one or the other of two liquids that differ in thermal characteristics, or as fluid flow sensor.

What is claimed is:

1. A liquid sensor comprising a frame, a temperature sensitive expansion element mounted on the frame, an electrical heater element operatively associated with the expansion element for applying heat to the expansion element to raise its temperature above ambient, and means actuated in response to changes in length of the expansion element for indicating change in temperature of the expansion element, the liquid being sensed being brought into heat transfer relation with the expansion element for removing heat from the expansion element to lower its temperature and actuate said indicating means, the expansion element including an elongated strip anchored at both ends to the frame, an elongated flat spring member forming a switching element anchored at one end to the frame, the other end of the spring member moving with bending of the spring member about the anchored end, and means connecting the spring member to the expansion element so that the spring member is deflected by lateral movement of the expansion element between the anchored ends.

2. Apparatus of claim 1 wherein the expansion element is an elongated strip anchored at both ends of the frame, an elongated flat spring member anchored at one end to the frame, the other end of the spring member moving with bending of the spring member about the anchored end, means connecting the spring member to the expansion element so that the spring member is deflected by lateral movement of the expansion element between the anchored ends.

3. Apparatus of claim 1 wherein the indicating means includes a switch, the moving end of the spring member operating the switch.

4. A liquid sensor comprising a frame having an elongated opening, a strip of material that expands and contracts with changes in temperature bridging the opening and anchored at both ends to the frame, a cantilever member anchored at one end to the frame, the cantilever member extending parallel to said strip, means wedging the cantilever member away from the strip to put the strip in tension, and heater means associated with the strip for heating the strip and decreasing the tension in the strip, the liquid being brought into thermally conductive relation with the strip to remove heat from the strip, and means indicating movement of the free end of the cantilever member.

5. Apparatus of claim 4 wherein the indicating means includes a switch actuated by movement of the cantilever member.

6. Apparatus of claim 5 wherein the heater means includes electrical resistance means in heat transfer relationship to the strip.

* * * * *